US005272898A

United States Patent [19]

Dittlo et al.

[11] Patent Number: 5,272,898

[45] Date of Patent: Dec. 28, 1993

[54] DEVICE FOR STAMPING MATERIALS IN SHEET FORM, ESPECIALLY SHEET METAL BLANKS

[75] Inventors: Michel Dittlo, Courbevoie; Gabriel De Smet, Nogent sur Oise, both of France

[73] Assignee: Isoform, Puteaux, France

[21] Appl. No.: 971,174

[22] Filed: Nov. 4, 1992

[30] Foreign Application Priority Data

Nov. 4, 1991 [FR] France ..... 91 13582

[51] Int. Cl.[5] ..... B21D 22/10

[52] U.S. Cl. ..... 72/57; 72/465; 29/421.1

[58] Field of Search ..... 72/57, 60, 63, 350, 72/351, 465; 29/421.1

[56] References Cited

U.S. PATENT DOCUMENTS

| | | | |
|---|---|---|---|
| 2,771,851 | 11/1956 | McGregor | 72/57 |
| 2,859,719 | 11/1958 | Downey . | |
| 4,770,015 | 9/1988 | De Smet | 72/57 |
| 4,833,903 | 5/1989 | de Smet | 72/57 |
| 5,067,336 | 11/1991 | de Smet | 72/57 |
| 5,081,859 | 1/1992 | De Smet | 72/57 |
| 5,119,658 | 6/1992 | de Smet | 72/57 |

FOREIGN PATENT DOCUMENTS

| | | |
|---|---|---|
| 0435722 | 7/1991 | European Pat. Off. . |
| 2590814 | 6/1987 | France . |

*Primary Examiner*—David Jones

*Attorney, Agent, or Firm*—Cushman, Darby & Cushman

[57] ABSTRACT

A device is provided for stamping materials in sheet form, especially sheet metal blanks (5), on a single-acting press. The device includes a cushion (2) made from an elastic material, forming a punch and housed in a retention dish (1) and means for preforming and permanently forming the sheet metal blank (5). The preforming and permanent forming means are arranged in a die (6) including a framework (8), an upper peripheral blank-clamp (9) connected to the framework (8) by at least on elastic member (11) for reaction, strain relief and retention and a die bottom (10) arranged in the upper peripheral blank-clamp (9). The upper peripheral blank-clamp (9) and the die bottom (10) are mounted so as to slide relative to one another and include means (13) for instantaneously linking them together.

14 Claims, 5 Drawing Sheets

DEVICE FOR STAMPING MATERIALS IN SHEET FORM, ESPECIALLY SHEET METAL BLANKS

Figure 1:
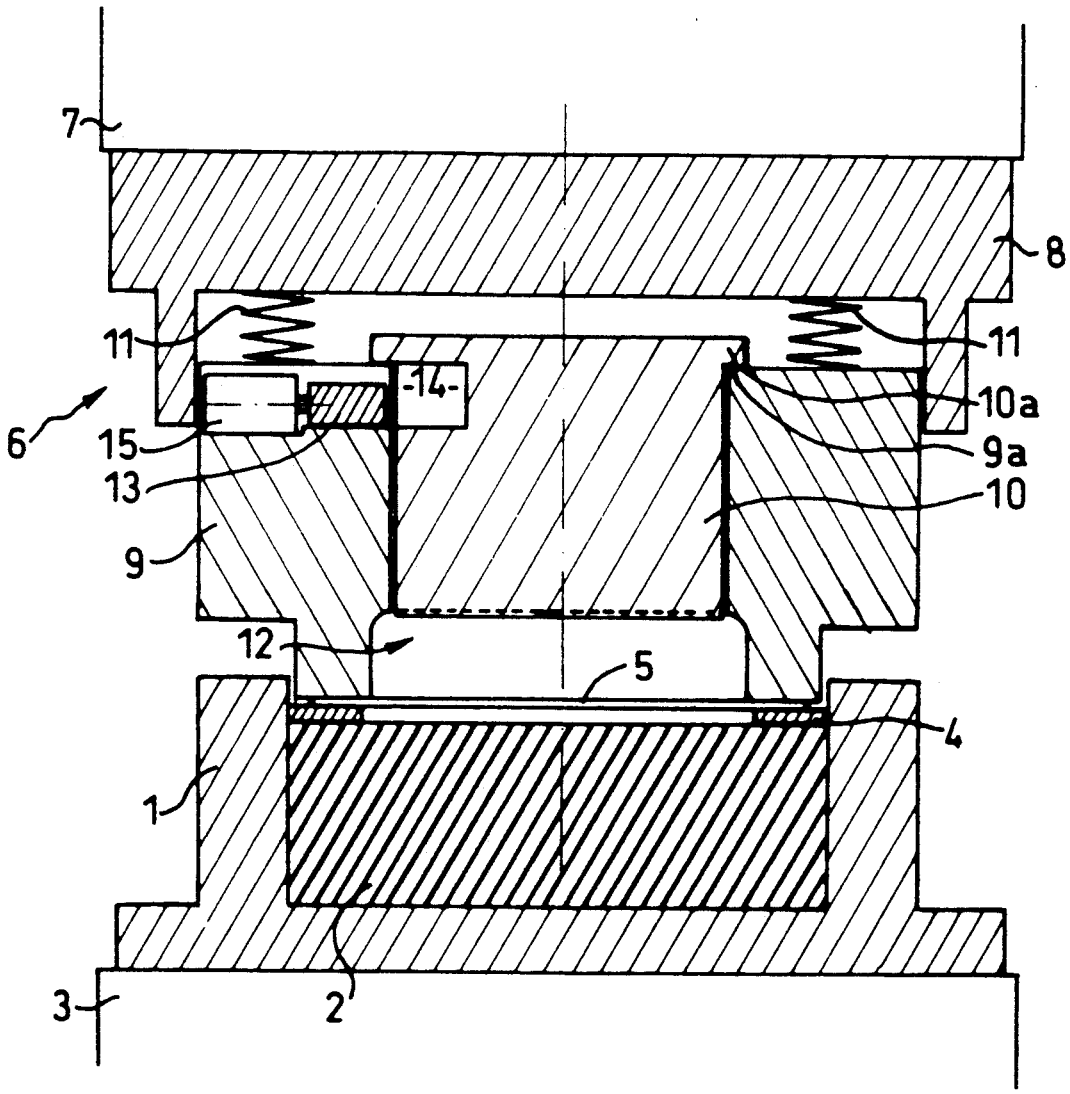

The subject of the present invention is a device for stamping materials in sheet form, especially sheet metal blanks, on a single-acting press of the type comprising, on the one hand, a cushion made from an incompressible elastic material, forming a punch and housed in a retention dish and, on the other hand, means for preforming and permanently forming the said sheet metal blank.

FR-A-2,641,215 discloses a device for stamping materials in sheet form, especially sheet metal blanks, comprising a cushion made from an elastic material housed in a retention dish, means for preforming the sheet metal blank consisting of an external hammer carrying an upper blank-clamp and means for permanently forming the sheet metal blank consisting of a central hammer acting on a punch.

This device also comprises a lower blank-clamp consisting of an element for supporting and holding at least part of the sheet metal blank, placed directly on the cushion and interacting with the upper blank-clamp so as to clamp the sheet metal blank at least in localized zones.

In order to form the sheet metal blank, the lower blank-clamp penetrates the retention dish and compresses the cushion of elastic material by reaction.

Thus the cushion, under the effect of this peripheral action, acts on the central zone of the sheet metal blank and brings about preforming of the blank.

The swelling of the central part of the sheet metal blank is limited by the punch so as to avoid erratic uncontrolled deformations.

Next, a central hammer of the press brings about the descent of the punch which at the same time entrains the upper peripheral blank-clamp for the final forming of the central part of the sheet metal blank.

Such a device necessarily comprises two hammers, one outer hammer carrying the upper blank-clamp and a central hammer acting on the punch.

However, bodywork transfer presses and the presses currently used by manufacturers of prototype or short-run components generally comprise a single stamping hammer.

It is therefore impossible to produce, with a press with a single hammer, called a single-acting press, using a single pressing cycle and with a single tool, a preforming operation and successively a permanent forming operation of the sheet metal blank by a technique known as elastic forming. Elastic forming is a technique in which plastic flow of the mass of the elastic cushion is brought about so as to uniformly deform the central part of the sheet metal blank so as to give it a surface area substantially equal to the surface area of the finished component to be obtained, and the central part of the previously drawn metal sheet is formed so as to give it the angular volume corresponding to the final shape of the component to be obtained.

The object of the present invention is to overcome these drawbacks by providing a device for stamping sheet metal blanks in particular, using the technique known as elastic forming with a single-acting press, that is to say, a press with one hammer.

The subject of the present invention is therefore a device for stamping materials in sheet form, especially sheet metal blanks, on a single-acting press comprising, on the one hand, a cushion made from an elastic material, especially an incompressible material, forming a punch and housed in a retention dish and, on the other hand, means for preforming and permanently forming the sheet metal blank, characterised in that the preforming and permanent forming means are arranged in a die comprising a framework, an upper peripheral blank-clamp connected to the framework by at least one elastic member for reaction, strain relief and retention and a die bottom arranged in the upper peripheral blank-clamp, the upper peripheral blank-clamp and the said die bottom being mounted so as to slide relative to one another and comprising means for instantaneously linking them together.

According to other characteristics of the invention:

the die bottom comprises a shoulder forming a stop and intended to interact with a bearing surface of the upper peripheral blank-clamp, the instantaneous linking means are formed by at least one movable element which can be displaced between a first position for locking the die bottom relative to the upper peripheral blank-clamp and a second position for unlocking the die bottom relative to the upper peripheral blank-clamp, the displacement of the movable element is synchronised with the cycle of the hammer of the press so as to lock the die bottom to the upper peripheral blank-clamp at the moment when the hammer reascends, the die bottom is connected to the framework by at least one elastic pressure and return member, the elastic reaction, strain relief and retention member of the upper peripheral blank-clamp and/or of the die bottom consists of elements chosen from amongst springs, hydraulic jacks, gas jacks, elastomer cushions or hydraulic cushions.

Other characteristics and advantages of the invention will emerge upon reading the description which follows given purely by way of example and made with reference to the appended drawings in which:

FIG. 1 is a diagrammatical sectional view of the stamping device according to the invention, FIGS. 2 to 5 are half-views in section showing the successive stages of preforming and forming a sheet metal blank.

The stamping device represented in FIG. 1 comprises a retention dish 1 forming a housing for a cushion 2 made of an elastic material, especially an incompressible material.

The retention dish 1 rests on a table 3 of a single-acting press.

On the upper face of the cushion 2 there is arranged, in this embodiment example, a lower peripheral blank-clamp 4 consisting of a frame, for example of closed outline, which substantially matches the shape of the internal housing of the retention dish 1 so as to be able to penetrate the housing at the moment when a sheet metal blank 5 placed on the lower peripheral blank-clamp 4 is formed.

The stamping device according to the invention comprises, above the retention dish 1, a die designated overall by the reference 6 and intended to interact with a hammer 7 of the single-acting press.

The die 6 comprises means for preforming and forming the sheet metal blank 5 and consists of a framework 8 on which the hammer 7 of the single-acting press bears, of an upper peripheral blank-clamp 9 arranged facing the lower peripheral blank-clamp 4 and of a die bottom 10 placed in the upper peripheral blank-clamp 9.

The upper peripheral blank-clamp 9 is formed by a frame with closed outline which substantially matches the shape of the internal housing of the retention dish 1 so as to be able to penetrate the housing and is connected to the framework 8 by at least one elastic member 11 for reaction, strain relief and retention.

The upper peripheral blank-clamp 9 and the die bottom 10 are mounted so as to slide freely relative to one another.

The die bottom 10 comprises, at its upper part, a shoulder 10*a* forming a stop and ensuring, when the latter is in contact with a bearing surface 9*a* of the upper peripheral blank-clamp 9, that is to say at the end of the stroke of the hammer 7, an impression 12 whose geometry corresponds to the shape of the component to be produced.

The position of the die bottom 10 for producing the impression 12 is ensured by the direct pressure of the framework 8 and of the hammer 7 on the die bottom 10 which presses via its shoulder 10*a* onto the bearing surface 9*a* of the upper peripheral blank-clamp 9 or, according to one variant, by means of at least one elastic member for reaction, strain relief and retention, not shown, interposed between the framework 8 and the die bottom 10.

The upper peripheral blank-clamp 9 and the die bottom 10 also comprise means for instantaneously linking them together, especially at the moment when the hammer 7 of the press re-ascends.

These instantaneous linking means are supported by the upper peripheral blank-clamp 9 and consist of a movable element 13, like a wedge for example, which can be displaced horizontally between, on the one hand, a first position in which the movable element 13 partially penetrates inside a housing 14 made in the die bottom, thus locking the die bottom 10 and the upper peripheral blank-clamp 9 (FIG. 4), and, on the other hand, a second position in which the movable element 13 is completely retracted (FIG. 1), freeing the die bottom 10 relative to the upper peripheral blank-clamp 9.

The displacement of the movable element 13 is controlled either manually, or for example by a jack 15 automatically synchronised with the displacement of the hammer 7 of the press.

The elastic members for reaction, strain relief and retention interposed between the framework 8 and the upper peripheral blank-clamp 9 and/or the die bottom 10 may consist, as a function of the forces exerted and of the bulk, for example, of springs, hydraulic jacks, gas jacks, hydraulic elastic cushions or cushions made of elastomer.

The sheet metal blank 5 is formed in the following fashion.

Firstly, the sheet metal blank 5 is positioned on the lower peripheral blank-clamp 4, the hammer 7 being in the raised position, then this hammer 7 and the die 10 descend progressively.

The upper peripheral blank-clamp 9 comes into contact with the sheet metal blank 5 whose peripheral part is progressively clamped between the upper peripheral blank-clamp 9 and the lower peripheral blank-clamp 4 (FIG. 1).

Figure 2:
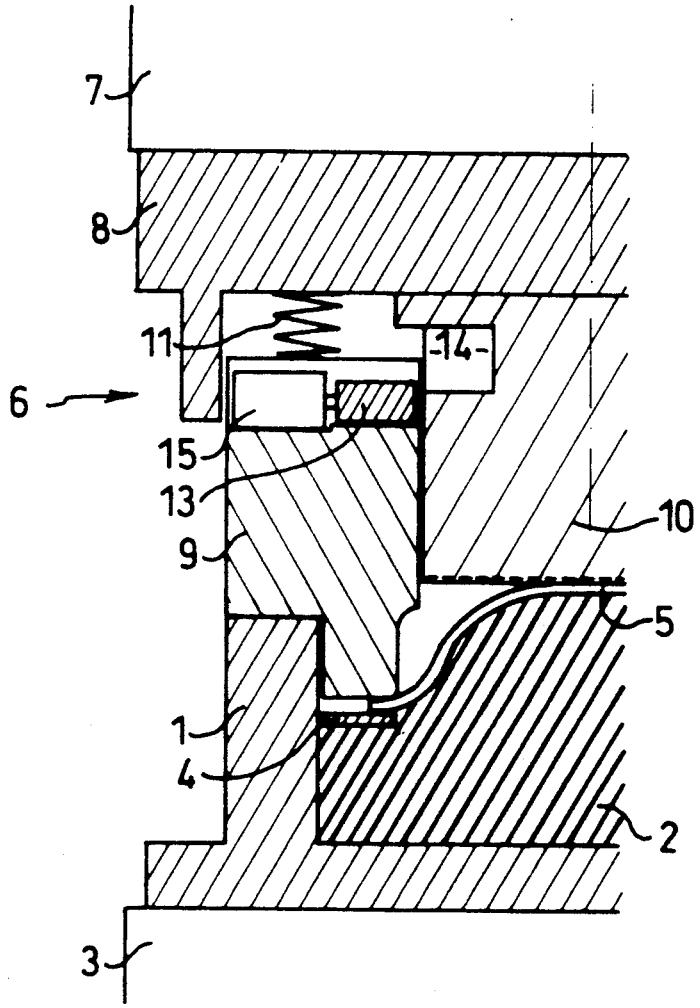

During the preforming stage represented in FIG. 2, the upper peripheral blank-clamp 9 compresses the cushion 2 under the force exerted, on the one hand, by the hammer 7 of the press and, on the other hand, by the elastic members 11.

The cushion 2, under the effect of this peripheral compression action, acts by plastic flow on the central zone of the sheet metal blank 5 and brings about the forming of the blank.

The die bottom 10 is then raised by the displacement of the sheet metal blank 5 deformed by the cushion 2.

Figure 3:
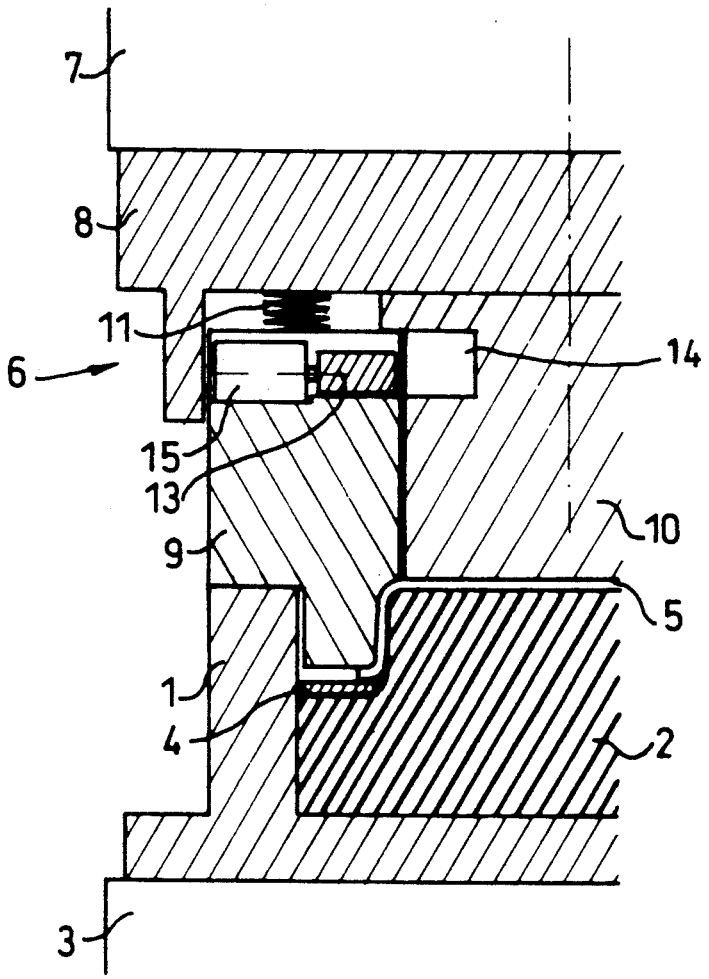

During the forming step represented in FIG. 3, the die bottom is subjected, either to the mechanical action of the hammer 7, or to the mechanical action exerted by an elastic member and by the hammer.

Under the effect of this action, the die bottom 10 is displaced towards a bottom position so as to bear by its shoulder 10*a* on the bearing surface 9*a* of the upper peripheral blank-clamp 9 and forms the central part of the sheet metal blank 5.

During the descent of the die bottom 10, a raising of the upper peripheral blank-clamp 9 due to the increase in pressure in the cushion 2 makes it possible to compensate for differences in volume between the preformed component and the formed component.

Figure 4:
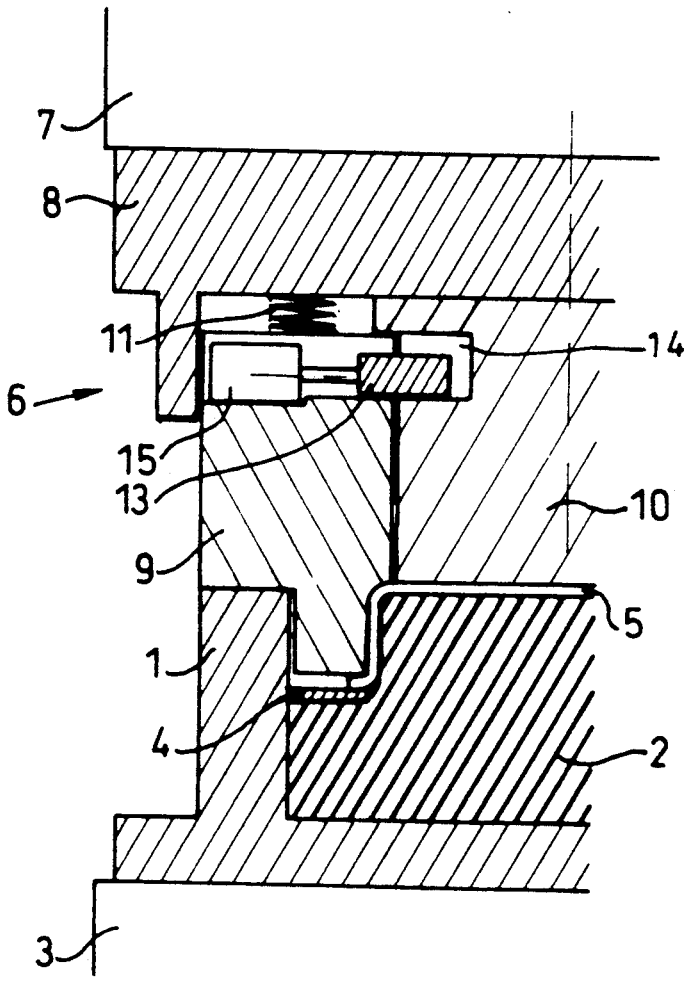
Figure 5:
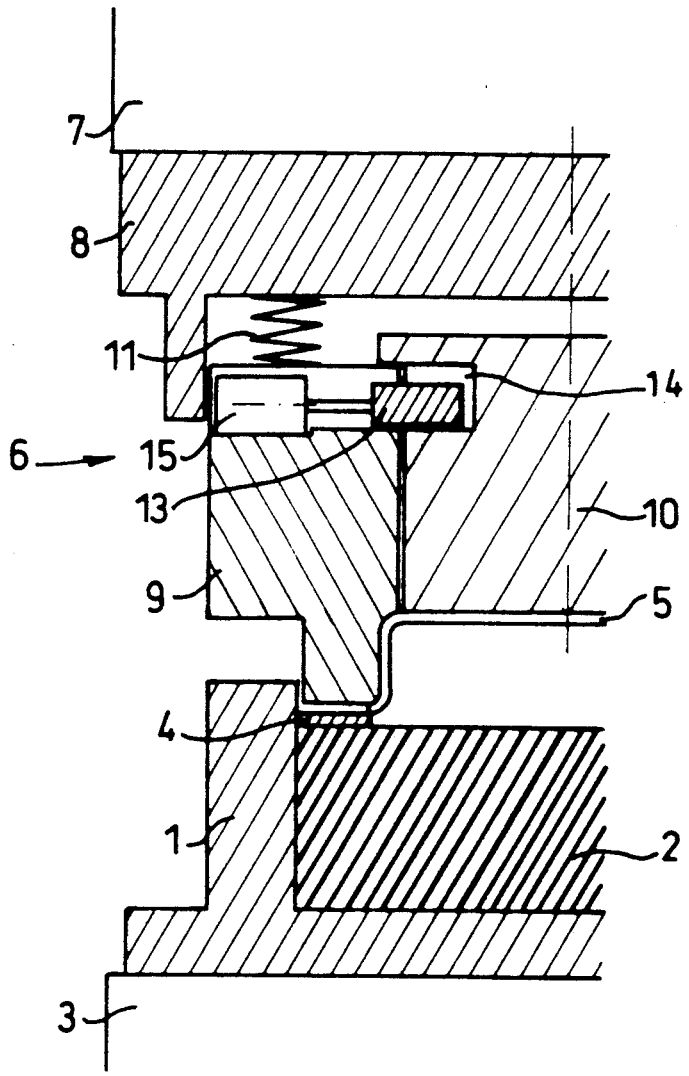

Next, the upper peripheral blank-clamp 9 and the die bottom 10 are locked by displacement of the movable element 13 which partially penetrates the housing 14 and is positioned on either side of the separation of the upper peripheral blank-clamp 9 and of the die bottom 10, as represented in FIG. 4.

When the component has been formed, the hammer 7 repositions itself in a raised position (FIG. 5), freeing the elastic members of the upper peripheral blank-clamp 9 and/or of the die bottom 10.

The upper peripheral blank-clamp 9 and the die bottom 10 re-ascend simultaneously, thus avoiding a deformation of the component by the pressure exerted by the cushion 2.

It is also possible to carry out calibration operations by arranging, above the cushion 2, a calibration punch, not shown, of a shape corresponding to the shapes of the finished component and of great Shore hardness, that is to say of a hardness greater than the hardness of the cushion material.

What is claimed is:

1. A device for stamping material in sheet form, the device being cooperable with a hammer of a single acting press, the device comprising:

a retaining member;

an elastic cushion housed within the retaining member; said elastic cushion defining a punch;

a die assembly disposed above the punch for operative engagement therewith so as to form the material, the die assembly including:

a frame member adapted to be coupled to the hammer;

at least one elastic member;

a clamp element coupled to the frame member by the at least one elastic member;

a die member coupled to the clamp element for relative sliding movement therewith; and a mechanism means for instantaneously linking the die member to the clamp element.

2. The device as claimed in claim 1, wherein the elastic cushion is made from compressible material.

3. The device as claimed in claim 1, wherein the die member includes a shoulder and the clamp element includes a bearing surface, the shoulder engaging the bearing surface so as to limit relative movement between the die member and the clamp element.

4. The device as claimed in claim 1, wherein the instantaneous linking mechanism includes at least one movable element which is movable from a first position locking the die member to the clamp element and a second position unlocking the die member from the clamp element.

5. The device as claimed in claim 4, wherein the movement of the movable element is synchronized with a cycle of the hammer so as to lock the die member to the clamp element when the hammer re-ascends.

6. The device as claimed in claim 1, wherein the die member is coupled to the frame member by at least one elastic element.

7. The device according to claim 1, wherein the elastic member includes a spring.

8. The device according to claim 1, wherein the elastic member includes a jack element.

9. The device according to claim 1, wherein the elastic member includes a cushion element.

10. The device according to claim 6, wherein the elastic element includes a spring.

11. The device according to claim 6, wherein the elastic element includes a jack element.

12. The device according to claim 6, wherein the elastic element includes a cushion element.

13. The device as claimed in claim 8, wherein the die member includes surface defining a notch portion, the movable member engaging the notch to lock the die member to the clamp element.

14. The device as claimed in claim 13, wherein the movable member is moved by a jack.

* * * * *